US007559712B2

(12) United States Patent
Lee

(10) Patent No.: US 7,559,712 B2
(45) Date of Patent: Jul. 14, 2009

(54) IMAGE FORMING APPARATUS HAVING A GUIDE MEMBER TO GUIDE PAPER

(75) Inventor: Yong-duk Lee, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 288 days.

(21) Appl. No.: 11/503,208

(22) Filed: Aug. 14, 2006

(65) Prior Publication Data

US 2007/0053735 A1 Mar. 8, 2007

(30) Foreign Application Priority Data

Sep. 6, 2005 (KR) ..... 10-2005-0082803

(51) Int. Cl.
*B41J 13/00* (2006.01)

(52) U.S. Cl. ..... 400/642; 400/619; 400/645

(58) Field of Classification Search ..... 400/619, 400/642, 645, 120.16; 347/220
See application file for complete search history.

(56) References Cited

U.S. PATENT DOCUMENTS 5,186,556 A 2/1993 Koyanagi
6,385,431 B1 5/2002 Arcaro et al.
6,981,810 B2 * 1/2006 Akashi et al. ..... 400/642

FOREIGN PATENT DOCUMENTS

| | | |
|---|---|---|
| JP | 08-080629 | 3/1996 |
| KR | 1998-24602 | 7/1998 |
| KR | 100185407 | 12/1998 |

OTHER PUBLICATIONS

Korean Office Action dated Oct. 20, 2006 issued in KR 2005-82803.

* cited by examiner

*Primary Examiner*—Daniel J Colilla
*Assistant Examiner*—Marissa L Ferguson-Samreth
(74) *Attorney, Agent, or Firm*—Stanzione & Kim LLP

(57) ABSTRACT

An image forming apparatus includes a conveying roller to convey a paper, a guide member to guide the paper conveyed by the conveying roller, a pressurizing roller to pressurize the paper guided by the guide member, and a heat transferring unit faced towards the pressurizing roller, the heat transferring unit being contacted with the paper to sequentially heat a surface of the paper. Thus, the image forming apparatus prevents a front end of the paper which is conveyed in an image forming unit from being caught during the conveyance.

21 Claims, 8 Drawing Sheets

IMAGE FORMING APPARATUS HAVING A GUIDE MEMBER TO GUIDE PAPER

CROSS-REFERENCE TO RELATED APPLICATIONS

This application claims priority from Korean Patent Application No. 2005-0082803, filed on Sep. 6, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus having a guide member to guide a paper which is conveyed to an image forming unit.

2. Description of the Related Art

In recent years, a conventional image forming apparatus such as a photo printer is mainly classified as either an apparatus (US patent laid open publication No. 2003-71887) in which an ink ribbon is heated by a thermal print head (TPH) to sublimate ink on a surface of the ink ribbon and to transfer the sublimated ink onto a printing medium and an apparatus (US patent laid open publication No. 2003-125206) in which a medium having at least one ink layer which reveals color when heat is applied thereto. The medium is heated by the above mentioned thermal print head to form the image. Thus, the image is formed without using the ink ribbon.

FIG. 1 and FIG. 2 are views illustrating an operation of a conventional image forming apparatus 100. Referring to FIGS. 1 and 2, the conventional image forming apparatus 100 comprises a paper feeding unit 110, a conveying roller 120 and an image forming unit 130.

The paper feeding unit 110 comprises a knock-up plate 111 on which the sheets of paper are stacked. The image forming unit 130 comprises a rotational plate 131 which is rotatably operated, a heat transferring unit 132 provided at a side of a surface of the rotational plate 131, and a pressurizing roller 133 for pressurizing the conveyed paper to the heat transferring unit 132.

FIG. 1 illustrates a state in which no printing medium is present in the conventional image forming apparatus 100. FIG. 2 illustrates a state in which a printing medium, such as a paper 1, is present in the conventional image forming apparatus 100 and fed therein. When the conventional image forming apparatus 100 is in a paper feeding state, the rotational plate 131 is rotated in a clockwise direction to enable the paper 1 to pass above the heat transferring unit 132. Also, the knock-up plate 111 is vertically rotated according to the rotation of the rotational plate 131.

The heat transferring unit 132 comprises a heater (not shown) provided at a front end portion 134 thereof and a driver integrated circuit (IC) 135 for controlling the heater. The driver IC 135 is provided with a cover 136 for preventing a sweeping phenomenon caused by the paper 1.

In the conventional image forming apparatus 100, however, there is a problem that a front end of the paper 1, which is conveyed to the heat transferring unit 132 through the conveying roller 120, can be caught on a front end portion 136*a* of the cover 136 of the heat transferring unit 132 so that the paper is not conveyed well.

SUMMARY OF THE INVENTION

The present general inventive concept provides an image forming apparatus which prevents a front end of a paper which is conveyed to an image forming unit from being caught.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus comprising a conveying roller to convey a paper, a guide member to guide the paper conveyed by the conveying roller, a pressurizing roller to pressurize the paper guided by the guide member, and a heat transferring unit face the pressurizing roller and to contact the paper to sequentially heat a surface of the paper.

The image forming apparatus may further comprise a rotation member to rotate the guide member so as to reciprocate between a standby position and a guiding position at which the paper is guided.

The rotating member may rotate the heat transferring unit according to a rotation of the guide member such that the heat transferring unit is reciprocated between a non-operation position and an operation position at which the heat transferring unit faces to the pressurizing roller and contacts the paper.

The rotating member may comprise a rotational plate to rotate together with the guide member and having the heating transferring unit mounted to a surface thereof, and a driving motor to rotate the rotational plate.

The rotation member may also include a rotational arm formed on the rotational plate and rotated together with the rotational plate, and the guide member is rotatably coupled with the rotational arm such that the guide member is reciprocated between the standby position and the guiding position according to a rotation of the rotational arm.

The rotational arm may have a protrusion formed thereon, and the guide member has a guide groove in which the protrusion is received and slid.

The foregoing and/or other aspects and utilities of the present general inventive concept may also be achieved by providing an image forming apparatus, comprising a conveying roller to convey paper, a pressure roller, a heat transferring unit to face the pressure roller to form an image on the paper, and a guide member disposed between the heat transfer unit and the conveying roller to guide the paper from the conveying roller to a gap between the pressure roller and the heat transferring unit.

The foregoing and/or other aspects and utilities of the present general inventive concept may also be achieved by providing an image forming apparatus, comprising a pressure roller, a base plate to rotate between a first half turn and a second half turn around a pressure roller, a rotational plate rotatably mounted on the base plate to move with respect to a rotational axis of the base plate, a heat transferring unit to rotate together with the rotational plate, a conveying roller to convey a printing medium, and a guide member to rotate with respect to a hinge axis of the base plate according to a movement of the rotational plate to guide the printing medium from the conveying roller to a gap between the pressure roller and the heat transferring unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
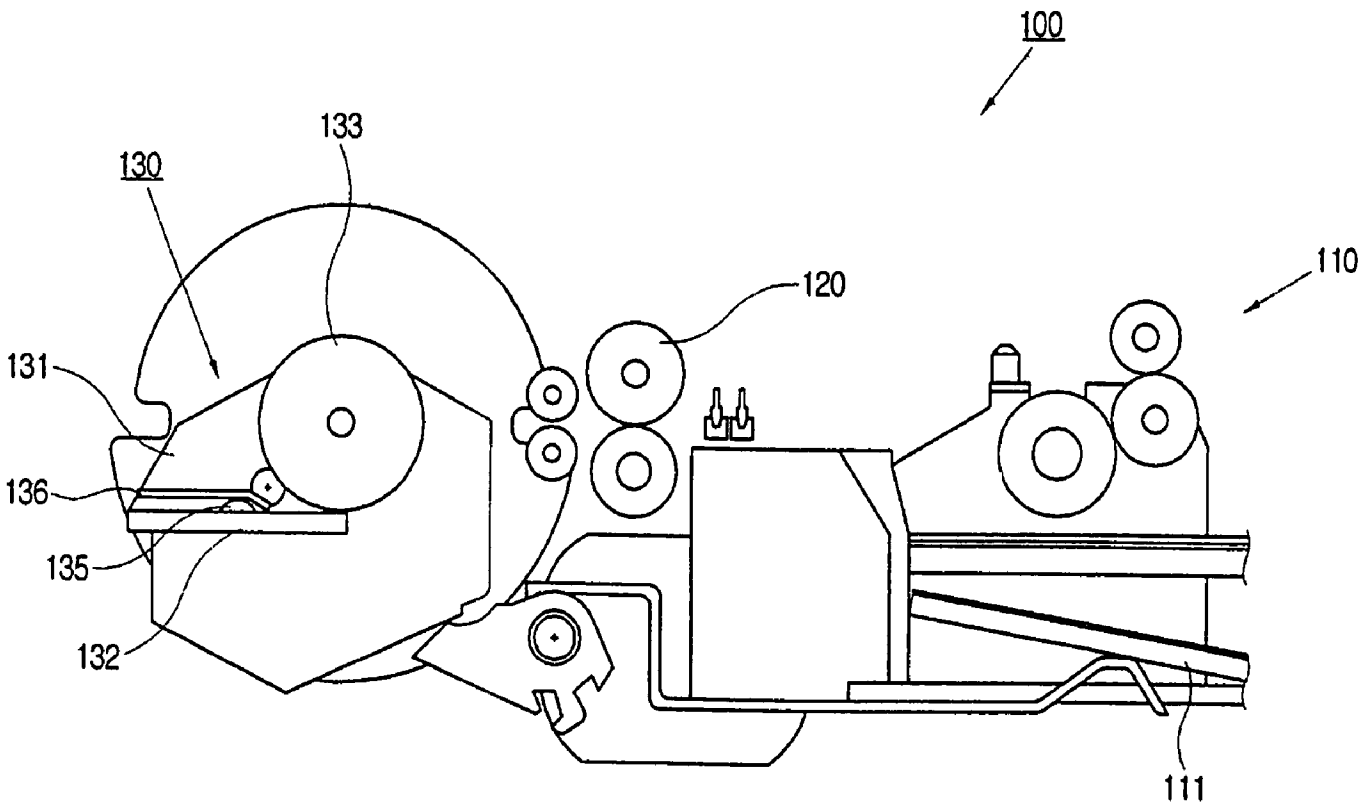
FIG. 1 (Prior Art)
FIG. 1 and FIG. 2 are views illustrating an operation of a conventional image forming apparatus.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 3:
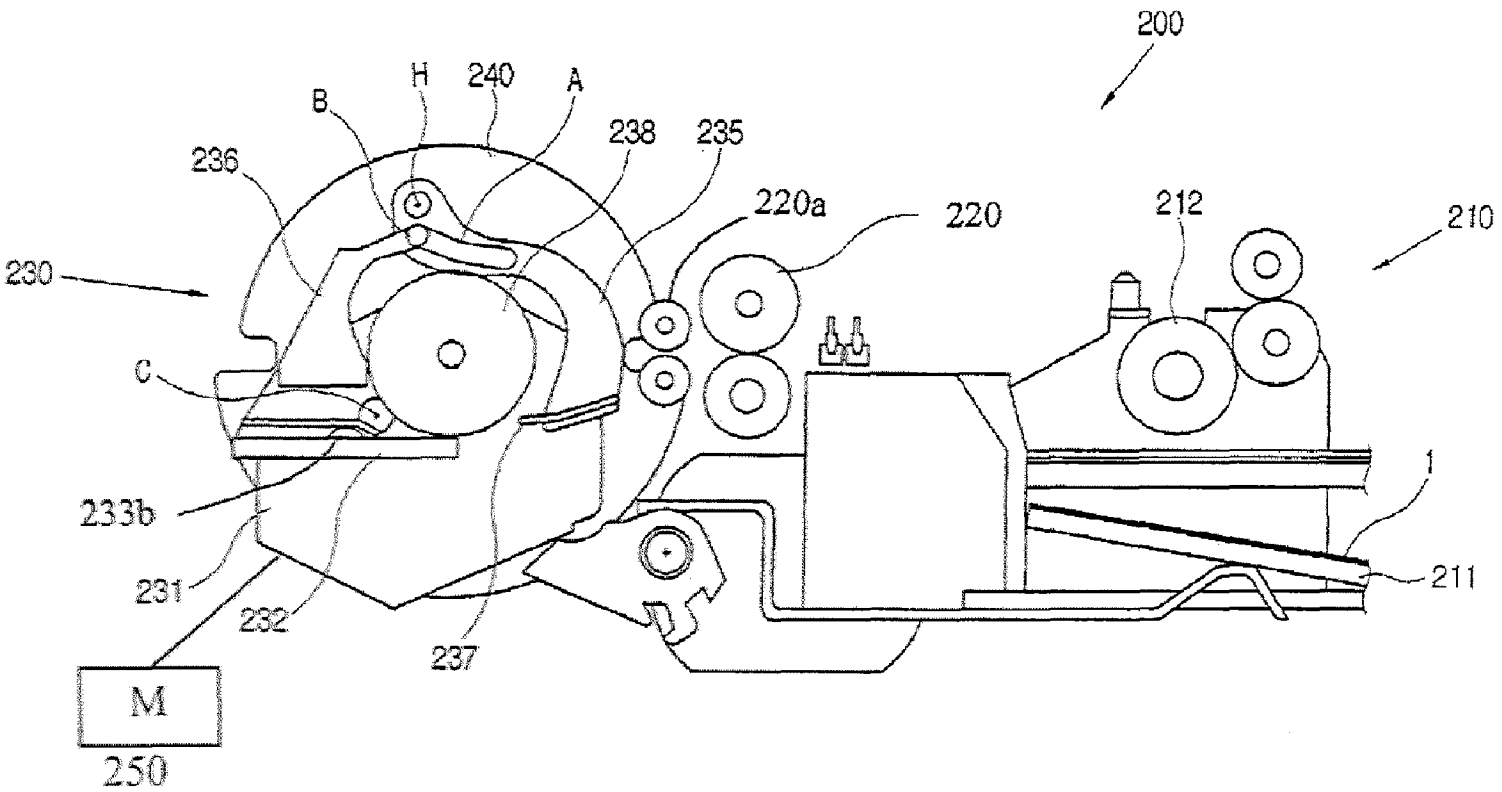
FIG. 3 is a view illustrating an image forming apparatus according to an embodiment of the present general inventive concept.

FIG. 3 is a view illustrating an image forming apparatus 200 according to an embodiment of the present general inventive concept. FIGS. 4 through 8 are views illustrating an operation of the image forming apparatus 200 according to an embodiment of the present general inventive concept. Referring to FIG. 3, the image forming apparatus 200 comprises a paper feeding unit 210, a conveying roller 220 and an image forming unit 230.

Figure 2:
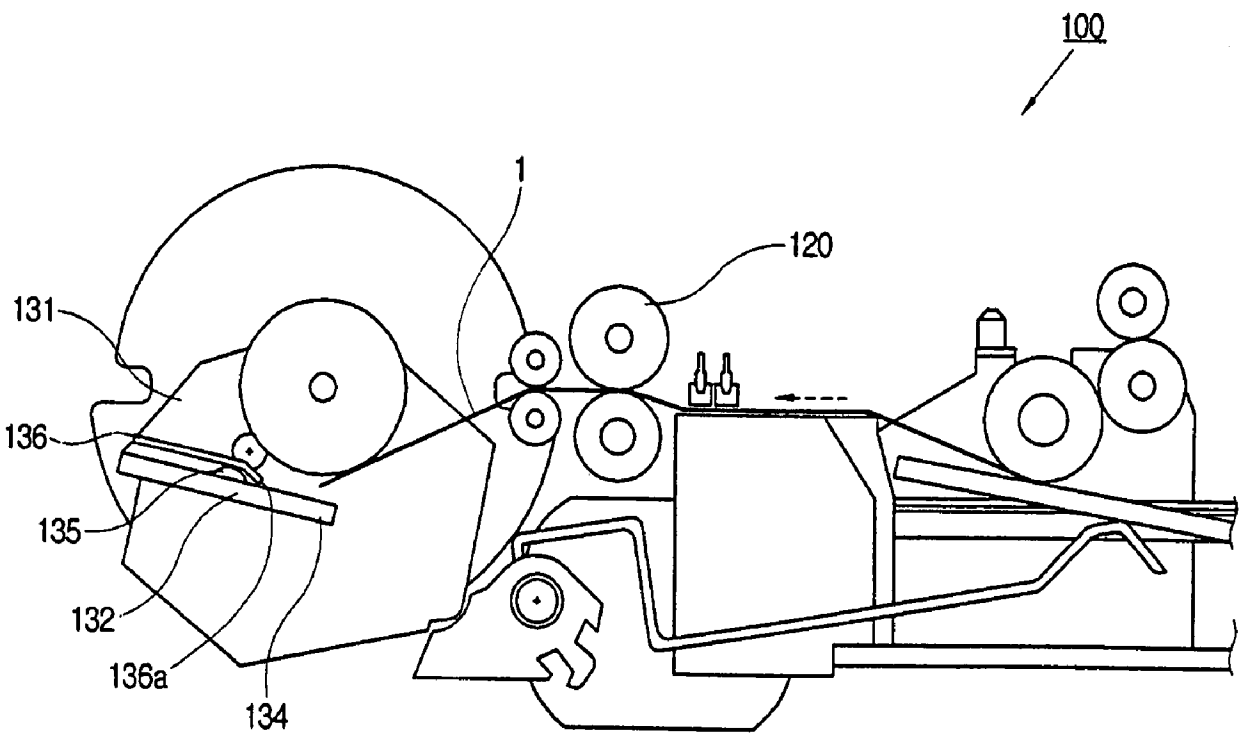
FIG. 2 (Prior Art)

In the description of the present embodiment, structural elements the same as those in the conventional image forming apparatus 100 of FIGS. 1 and 2. Accordingly, descriptions thereof are omitted.

Figure 4:
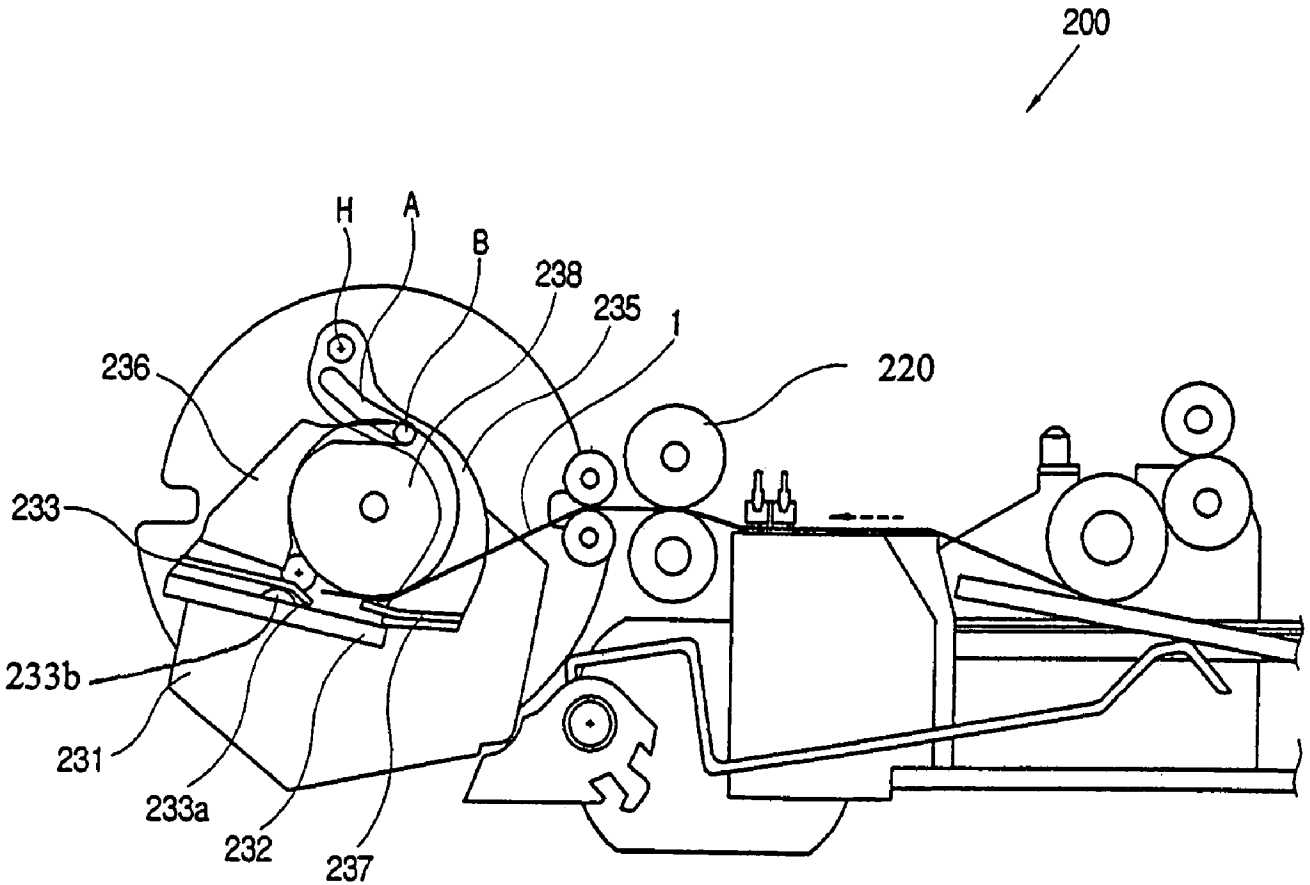
FIGS. 4 to 8 are views illustrating an operation of the image forming apparatus of FIG. 3 according to an embodiment of the present general inventive concept.

Referring to FIGS. 3 and 4, once a rotational plate 231 is rotated to feed a paper 1, a knock-up plate 211 is moved upward, and the paper 1 loaded on the knock-up plate 211 is brought into contact with a pick-up roller 212. The paper 1 is picked-up by a rotation of the pick-up roller 212 and fed to the conveying roller 220. An additional conveying roller 220*a* receives the paper 1 from the conveying roller 220. The paper 1 fed to the conveying roller 220 is entered into a heat transferring unit 232 of the image forming unit 230.

The image forming unit 230 comprises a guide member 235 to guide the paper 1 which is conveyed from the conveying roller 220, and a rotational arm 236 having a protrusion B which is received and slides in a guide groove A formed in the guide member 235. The guide member 235 has a hinge unit H formed at an upper end thereof, and coupled to a base plate 240. The guide member 235 is rotatably supported by the base plate 240 through the hinge unit H. The rotational arm 236 is securely fastened to the rotational plate 231.

The heat transferring unit 232 is mounted to a surface of the rotational plate 231. The heat transferring unit 232 is rotated between a non-operation position (illustrated in FIG. 4) and an operation position (illustrated in FIGS. 3 and 6), according to a rotation of the rotational plate 231, as described below. That is, as illustrated in FIG. 3, the heat transferring unit 232 is in the operation state and is adjacent to the pressurizing roller 238. As illustrated in FIG. 4, the heat transferring unit is in the non-operation state and is spaced apart from the pressurizing roller 238.

The rotational plate 231 is rotated about a rotational center C and is coupled hingeably with the base plate 240, and the rotation of the rotational plate 231 with respect to the base plate 240 and the rotation center C is controlled by a separate motor 250 (as shown in FIG. 3) coupled with the rotational plate 231. Also, a rotation of the base plate 240 is controlled by another driving motor as described below.

When the rotational plate 231 is rotated about the rotation center C in a clockwise direction, the rotational arm 236 is rotated together with the rotational plate 231. Due to the rotation of the rotational arm 236 and the rotational plate 231, the protrusion B of the rotational arm 236 slides in the guide groove A of the guide member 235, so that the guide member 235 is rotated about the hinge shaft H in the clockwise direction.

In order to guide the paper 1 fed through the conveying rollers 220 and 220*a*, a guide 237 is formed at one end portion of the guide member 235. As described above, the guide member 235 is reciprocated between a standby position (illustrated in FIG. 3) and a guiding position (illustrated in FIG. 4) at which the paper 1 is guided.

Figure 5:
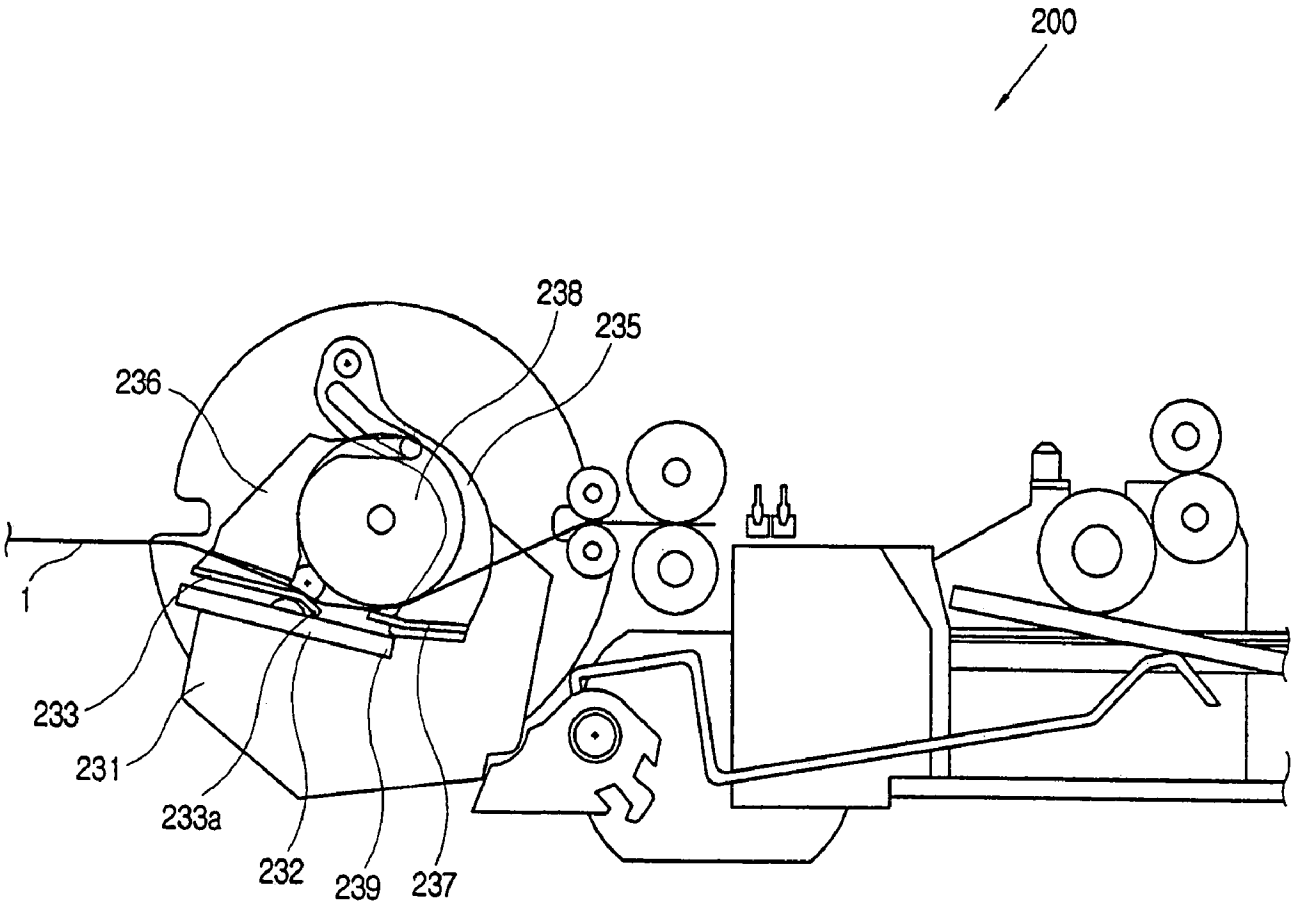

Referring to FIG. 5, the paper 1 fed by the conveying rollers 220 and 220*a* contacts an upper side surface of a cover 233 of the heat transferring unit 232 by the guide 237 of the guide member 235 without contacting with a front end portion 233*a* of the cover 233, and is thus conveyed to a left side of the image forming unit 230. The cover 233 covers a driving IC 233*b* mounted on a heat transfer unit plate of the heat transfer unit 232. The upper side surface of the cover 233 receives a leading edge of the paper 1 from the guide 237.

Figure 6:
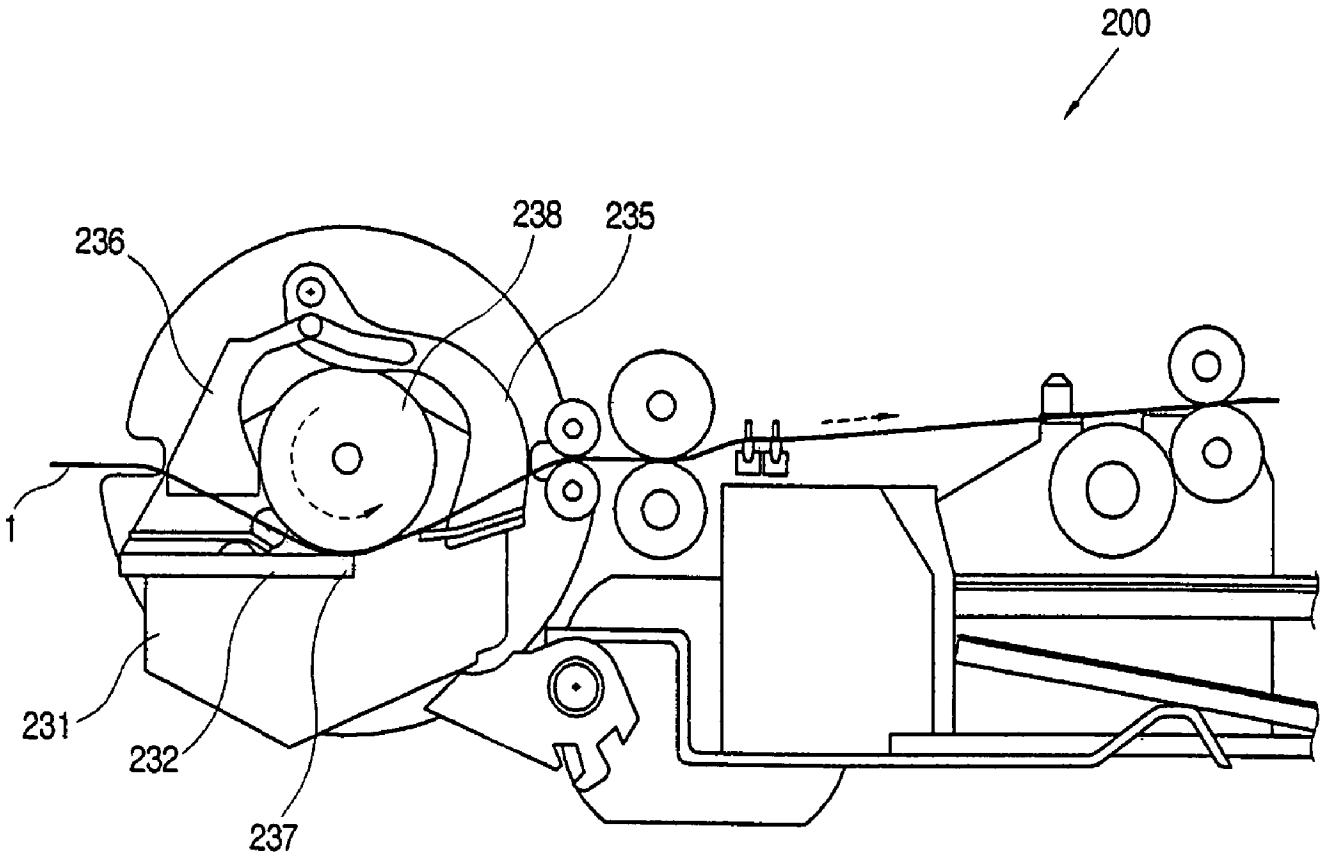

Referring to FIGS. 5 and 6, in a case that the leading edge of the paper 1 is conveyed to the left side of the image forming unit, the rotational plate 231 is returned to an original position thereof, that is, rotated in a counterclockwise direction so that a trailing edge of the paper 1 is contacted with the heater (which is not shown but located at one end portion 239 of the heating transferring unit 232) by the pressurizing roller 238. In this case, the rotational arm 236 is rotated in the counterclockwise direction together with the rotational plate 231, and the guide member 235 is also rotated in the counterclockwise direction with respect to the rotational center C and/or the hinge unit H due to the rotation of the rotational arm 236.

Referring to FIG. 6, the paper 1 is gradually conveyed to a right side of the image forming apparatus 200 by a rotation of the pressurizing roller 238 so that a print operation is performed by the heat transferring unit 232 in the operation position. In this case, the ink provided on the paper 1 as a film layer is heated by the heat transferring unit 232 to reveal the color of the ink, and thus the image is formed on a first side of the paper 1.

Figure 7:
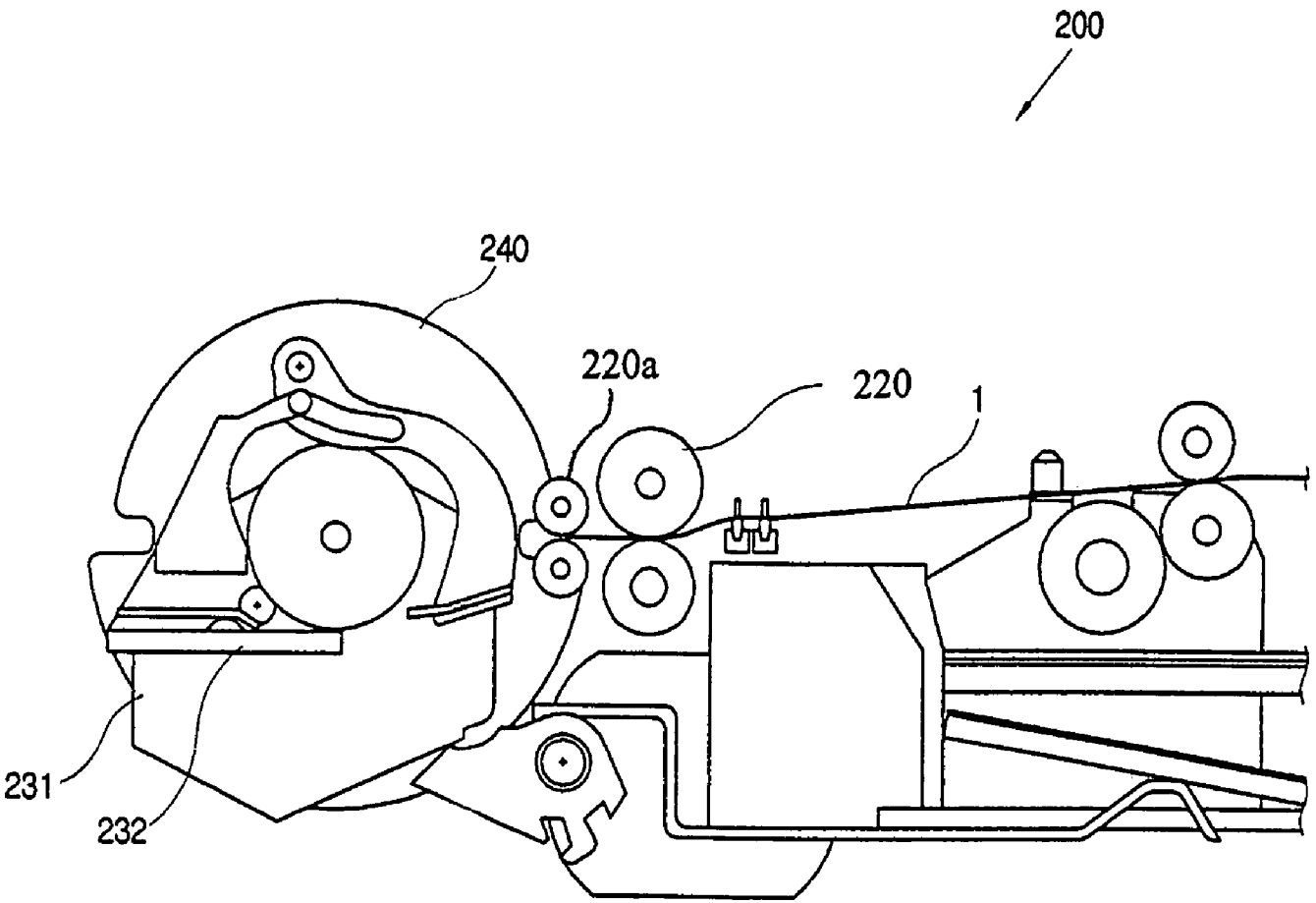
Figure 8:
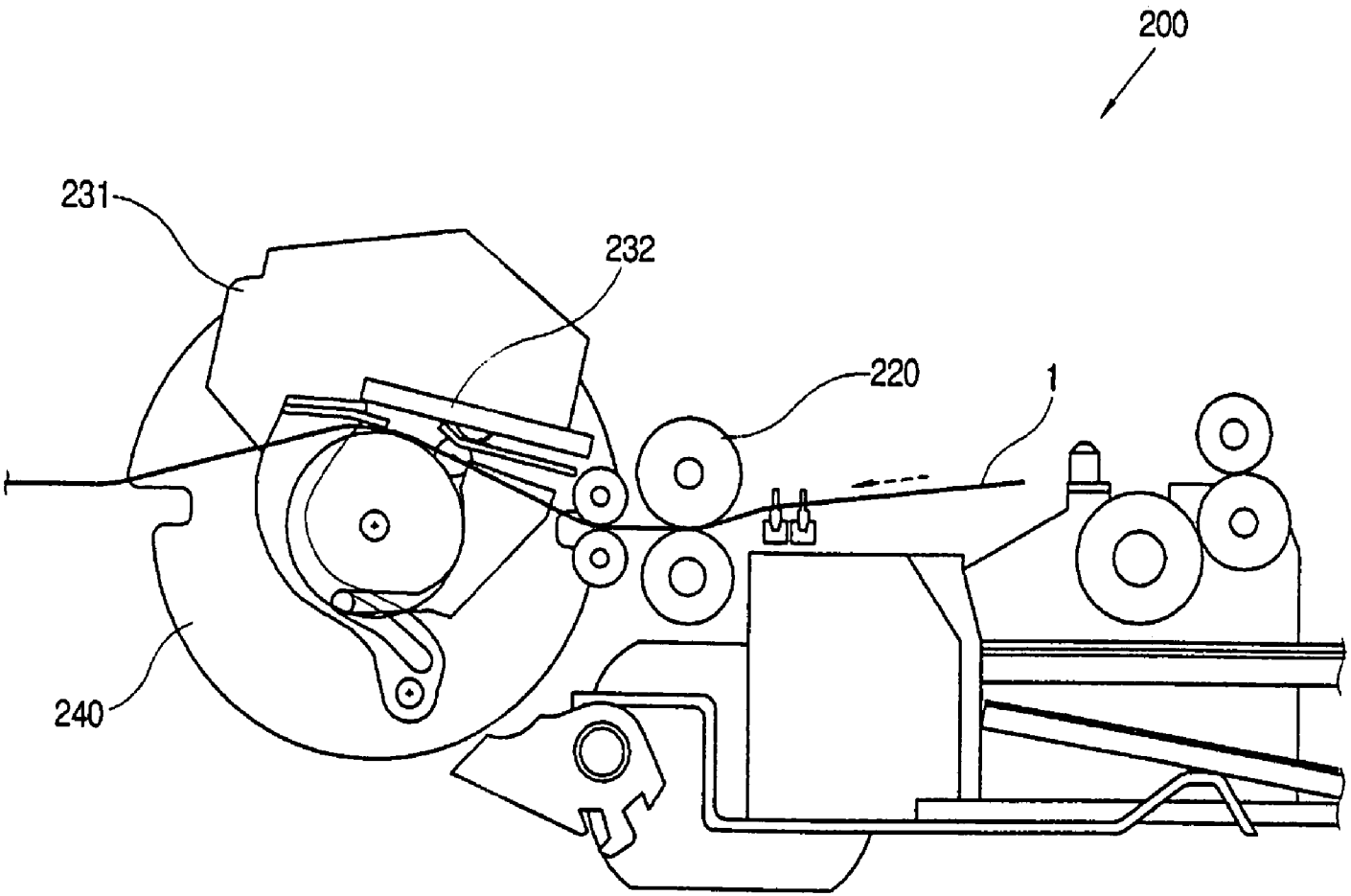

Referring to FIGS. 7 and 8, in a case that a left side end of the paper 1 is conveyed to the conveying roller 220*a* and the formation of the image having a color corresponding to the film layer of the paper 1 is complete (FIG. 7), a control unit (not illustrated) provided in the image forming apparatus 200 controls the base plate 240 to rotate through a half turn (FIG. 8), After the half turn from a first position of FIG. 7, the base plate 240 is placed in a second position (FIG. 8). In the second position, the heat transferring unit 232 is provided on a second side of the paper 1, and the second side of the paper 1 can have a second image formed thereon. The control unit then controls the image forming apparatus 200 to pass the paper 1 through the heat transferring unit 232 to develop the second image on a layer of ink of the second side of the paper 1. The control unit will control the image forming apparatus 200 to sequentially heat the remaining film layers to thereby reveal the image. That is, the control unit can control the image forming apparatus to sequentially heat both sides of the paper 1 to form images thereon.

Once the conveyance of the paper 1 is completed, the base plate 240 is rotated a half turn again and returned to the original position (illustrated in FIG. 3).

The reciprocation of the paper 1, as described above, may be performed repeatedly for each of the film layers. For example, if the film layer consisted of 3 films having cyan, magenta and yellow colors, respectively, the reciprocation of the paper 1 will be repeated three times to carry out the printing process.

As described above, in an image forming apparatus according to the present general inventive concept, a paper to be conveyed by a conveying roller is guided by a guide member to prevent the paper from being caught on a cover of a heat transferring unit or a heater provided in the heat transferring unit, and thus, damage to the paper is prevented.

As described above, an image forming apparatus according to the present general inventive concept includes a guide member rotated between a standby position and a guiding position so that the paper can be conveyed smoothly.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a conveying roller to convey a paper;

a guide member to guide the paper conveyed by the conveying roller and to move between a standby position and a guiding position at which the paper is guided;

a pressurizing roller to pressurize the paper guided by the guide member; and a heat transferring unit to face the pressurizing roller and to contact the paper to sequentially heat a surface of the paper, wherein at least a portion of the guide member intervenes in a gap between the heat transferring unit and the pressurizing roller when the guide member is located in the guiding position, and the guide member escapes from the gap when the guide member is located in the standby position.

2. The image forming apparatus according to claim 1, further comprising:

a rotation member to rotate the guide member.

3. The image forming apparatus according to claim 2, wherein the rotation member rotates the heat transferring unit according to a rotation of the guide member such that the heat transferring unit is reciprocated between a non-operation position and an operation position at which the heat transferring unit faces the pressurizing roller and contacts the paper.

4. The image forming apparatus according to claim 3, wherein the rotation member comprises:

a rotational plate to rotate together with the guide member and having the heating transferring unit mounted to a surface thereof; and a driving motor to rotate the rotational plate.

5. The image forming apparatus according to claim 4, wherein:

the rotation member further comprises a rotational arm formed on the rotational plate and rotated together with the rotational plate; and the guide member is rotatably coupled with the rotational arm such that the guide member is reciprocated between the standby position and the guiding position according to a rotation of the rotational arm.

6. The image forming apparatus according to claim 5, wherein the rotational arm comprises a protrusion formed thereon, and the guide member comprises a guide groove formed therein to receive the protrusion to slide therein.

7. An image forming apparatus, comprising:

a conveying roller to convey paper;

a pressure roller;

a heat transferring unit to face the pressure roller to form an image on the paper; and a guide member disposed between the heat transfer unit and the conveying roller to guide the paper from the conveying roller to a gap between the pressure roller and the heat transferring unit, and to move between a standby position and a guiding position at which the paper is guided, wherein at least a portion of the guide member intervenes in a gap between the heat transferring unit and the pressurizing roller when the guide member is located in the guiding position, and the guide member escapes from the gap when the guide member is located in the standby position.

8. The image forming apparatus of claim 7, wherein the heat transferring unit comprises a driver IC and a cover to cover the driver IC, and the guide member guides the paper to an upper surface of the cover facing the pressure roller.

9. The image forming apparatus of claim 8, wherein the guide member prevents the paper from being caught by an end of the cover.

10. The image forming apparatus of claim 7, further comprising:

a base plate; and a rotational plate to rotate with respect to the base plate, wherein the heat transferring unit and the guide member rotate according to a rotation of the rotational plate.

11. The image forming apparatus of claim 10, wherein the heat transferring unit rotates with respect to an axis of the rotational plate, and the guide member rotates with respect to an axis of the base plate.

12. The image forming apparatus of claim 11, wherein the axis of the rotational plate and the axis of the base plate are disposed around the pressure roller.

13. The image forming apparatus of claim 7, wherein the heat transfer unit moves between an operation position to form the image on the paper and a non-operation position to receive the paper through the gap formed with the pressure roller, and the guide position and the non-guide position correspond to the non-operation position and the operation position of the heat transferring unit, respectively.

14. The image forming apparatus of claim 7, further comprising:

a rotational plate rotatable with respect to the pressure roller, wherein the heat transferring unit is formed on the rotational plate to rotate around the pressure roller, and the guide member is connected to the rotational plate to move between the heat transferring unit and the conveying roller.

15. The image forming apparatus of claim 14, wherein the rotational plate further comprises:

a rotational arm to rotate together with the heat transferring unit, and the guide member rotates around the pressure roller to guide a leading edge of the paper to a gap between the heat transferring unit and the pressure roller.

16. The image forming apparatus of claim 15, wherein:

the rotational arm comprises a protrusion; and the guide member comprises a guide groove to receive the protrusion, and the guide groove has a length so that the guide member does not move when the rotational arm moves by the length.

17. The image forming apparatus of claim 7, wherein the guide member comprises a guide extended in a direction from the conveying roller to the heat transfer unit.

18. The image forming apparatus of claim 7, further comprising:

a rotational plate to rotate around the pressure roller, wherein the heat transferring unit rotates together with the rotational plate between a first position and a second position to have a first gap and a second gap with the pressure roller, respectively, and the guide moves between a guide position and a non-guide position to correspond to the first position and the second position of the heat transferring unit.

19. The image forming apparatus of claim 18, wherein when the second gap is greater than the first gap, the guide member moves from guide position and the non-guide position to guide the paper from the conveying roller to the second gap.

20. The image forming apparatus of claim 18, wherein the heat transferring unit comprises a plate having a distal end, a drive IC formed on a portion of the heat transferring unit plate, and a cover to cover the driver IC, and the guide member comprises a guide disposed between the pressure roller and the distal end of the plate.

21. An image forming apparatus, comprising:

a pressure roller;

a base plate to rotate between a first half turn and a second half turn around a pressure roller;

a rotational plate rotatably mounted on the base plate to move with respect to a rotational axis of the base plate;

a heat transferring unit to rotate together with the rotational plate;

a conveying roller to convey a printing medium; and a guide member to rotate with respect to a hinge axis of the base plate according to a movement of the rotational plate to guide the printing medium from the conveying roller to a gap between the pressure roller and the heat transferring unit, and to move between a standby position and a guiding position at which the paper is guided, wherein at least a portion of the guide member intervenes in a gap between the heat transferring unit and the pressurizing roller when the guide member is located in the guiding position, and the guide member escapes from the gap when the guide member is located in the standby position.

* * * * *